US006266987B1

(12) United States Patent
Goto et al.

(10) Patent No.: US 6,266,987 B1
(45) Date of Patent: Jul. 31, 2001

(54) DISK ROLL EXCHANGING APPARATUS FOR VERTICAL PIERCING MILL AND DISK ROLL EXCHANGING METHOD

(75) Inventors: Hisao Goto; Masaomi Nakamura, both of Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/548,390

(22) Filed: Apr. 12, 2000

Related U.S. Application Data

(63) Continuation of application No. PCT/JP98/04627, filed on Oct. 14, 1998.

(30) Foreign Application Priority Data

Oct. 14, 1997 (JP) ..... 9-280089

(51) Int. Cl.[7] ..... B21B 31/08
(52) U.S. Cl. ..... 72/95; 72/238
(58) Field of Search ..... 72/95, 96, 97, 72/99, 238

(56) References Cited

U.S. PATENT DOCUMENTS 4,387,584 * 6/1983 Akita et al. ..... 72/95
5,479,805 * 1/1996 Koenen et al. ..... 72/95

FOREIGN PATENT DOCUMENTS 58-138507 * 8/1983 (JP) ..... 72/239
59-1008 1/1984 (JP) .
63-64248 12/1988 (JP) .
5-200412 8/1993 (JP) .

* cited by examiner

*Primary Examiner*—Lowell A. Larson
(74) *Attorney, Agent, or Firm*—Armstrong, Westerman, Hattori, McLeland, & Naughton, LLP

(57) ABSTRACT

The disk roll exchanging apparatus of the present invention includes a pair of disk frames 6 which support disk rolls 3 and which are capable of swinging open, a disk roll lifting device 12 for mounting the disk roll to and demounting it from the opened disk frames, and a horizontally moving device 18 for carrying and horizontally moving the disk roll lifting device, thereby allowing the disk roll to be mounted to and demounted from the opened disk frame. According to the exchanging method of the present, a pair of disk frames 6 that support disk rolls 3 are swung open sideways and are fixed at the open positions. Thereafter, a disk roll lifting device 12 carried on a horizontally moving device 18 is transferred to a disk roll engaging/disengaging position, and subsequently, the disk roll is lowered while releasing the disk roll from the disk frame, to thereby fixedly support the disk roll by the disk roll lifting device. The disk roll lifting device is then moved away from the disk roll exchange position.

8 Claims, 7 Drawing Sheets

DISK ROLL EXCHANGING APPARATUS FOR VERTICAL PIERCING MILL AND DISK ROLL EXCHANGING METHOD

This application is a continuation of international application PCT/JP98/04627 filed on Oct. 14, 1998.

TECHNICAL FIELD OF THE INVENTION

The present invention relates to a disk roll exchanging apparatus for use in a vertical piercing mill used for manufacturing seamless steel tubes and to a disk roll exchanging method employed thereby, and more particularly to a disk roll exchanging apparatus which enables automatic exchange of disk rolls in accordance with a changeover schedule so as to reduce time for exchange and which is used in a vertical piercing mill suitable for flexible manufacture of a variety of differently-sized seamless steel tubes in small quantities, and to a disk roll exchanging method employed thereby.

BACKGROUND ART OF THE INVENTION

As a method of manufacturing seamless steel tubes under hot working conditions, the Mannesmann tube-making process is widely employed. In this tube-making process, a round billet heated to a high temperature is fed as a material to be rolled into a piercing mill (a so-called "piercer"), which pierces the axial center portion of the round billet to obtain a hollow shell. The thus-obtained hollow shell is fed, directly or as needed after undergoing an expansion or wall-thinning process in an elongator having the same structure as that of the piercing mill, into a subsequent elongating mill such as a plug mill, a mandrel mill, or the like so as to be elongated. Subsequently, the thus-elongated tube undergoes a finishing process provided by a stretch reducer for shape correction, a reeler for polishing, and a sizer for sizing, thereby becoming a seamless steel tube product.

FIG. 1 shows the material being pierced and an arrangement of piercing rolls and disk rolls in a piercing mill. Piercing rolls 2, 2 are axisymmetrically arranged such that each of the piercing rolls 2, 2 forms a predetermined cross angle and inclination angle with respect to the pass line X—X along which a round billet 1 serving as the material is rolled. Disk rolls 3 are arranged in proximity to and in a manner perpendicularly intersecting with the piercing rolls 2 such that the disk rolls 3 are opposed to one another with the round billet held in-between, and rotate independently of each other about respective shafts 4. In the piercing mill with the piercing rolls 2, 2 arranged as above, when the round billet 1 is fed along the pass line X—X in the direction indicated by the illustrated white arrow, the round billet 1 is caught between the piercing rolls 2 and is transferred along the pass line X—X while being rotated, during which the round billet 1 is pierced at its axial center portion by an unillustrated plug so as to become a hollow shell. During this piercing process, the disk rolls 3 follow the movement of the round billet 1 and rotate in the direction of the pass line X—X so as to prevent the round billet 1 from deflecting, to thereby establish smooth piercing.

In general, a piercing mill employing such a roll arrangement as shown in FIG. 1, in which a pair of piercing rolls are opposingly arranged in a vertical direction with a pass line running in-between, and a pair of disk rolls are opposingly arranged in a horizontal direction, is usually called a "vertical piercing mill." In recent years, vertical piercing mills have widely been used in a seamless steel tube manufacturing process.

As described above, since piercing mill forces the high-temperature material between piercing rolls, the working surfaces of the piercing rolls are degraded with rolling time. Also, since disk rolls are in contact with the material during rolling, their surfaces unavoidably wear. Accordingly, the piercing rolls and the disk rolls must be replaced periodically. Particularly, exchanging disk rolls involves the steps of opening a mill housing and lifting the disk rolls up one after another for exchange through use of an overhead crane. Since exchanging a pair of disk rolls through use of an overhead crane takes a considerable amount of time, a reduction in the working ratio of the piercing mill is unavoidable.

Various improvements have been proposed for solving the above-described problem involved in disk roll exchange. For example, Japanese Patent Application Publication (kokoku) No. 63-64248 discloses the structure of a piercing mill which allows disk rolls to be replaced without use of an overhead crane. However, this proposed structure is only applicable to the case where a disk roll is supported in a cantilever manner on the driving shaft side. This cantilever-like support of a disk roll has the problem that the disk roll is not positioned in a sufficiently rigid manner during operation. That is, since the cantilever-like support of a disk roll involves a reduction in supporting rigidity, the disk roll may deflect from the material during piercing, resulting in the marking of scratches on the material surface.

By contrast, when a disk roll is supported at both ends of its shaft in order to secure a sufficient supporting rigidity for the disk roll, the structure of a supporting apparatus for a disk roll becomes complex. Thus, a disk roll exchanging apparatus applicable to such a complex supporting apparatus becomes large-scaled, resulting in a potential significant reduction in workability of disk roll exchange. This reduction in workability of disk roll exchange affects not only the working ratio of a piercing mill but also an overall efficiency of manufacture of seamless steel tubes, particularly when a continuous Mannesmann tube-making process is carried out for high efficiency production of seamless steel tubes as has been practiced in recent years.

SUMMARY OF THE INVENTION

In view of the above-described problems involved in disk roll exchanging work for a vertical piercing mill employed in a seamless steel tube manufacturing process, an object of the present invention is to provide a disk roll exchanging apparatus which enables automatic exchange of disk rolls by a simple structure and without reducing its workability even when the disk rolls are supported at both ends of their shaft, and which is used in a vertical piercing mill suitable for flexible manufacture of a variety of differently-sized seamless steel tubes in small quantities, as well as a disk roll exchanging method employed thereby.

The present invention provides (1) a disk roll exchanging apparatus for use in a vertical piercing mill and (2) a disk roll exchanging method employed by the apparatus, as shown in FIGS. 3 and 4, and described below. (1) A disk roll exchanging apparatus for use in a vertical piercing mill containing a pair of piercing rolls and a pair of disk rolls 3 in a mill housing such that the piercing rolls are opposingly arranged in a vertical direction with a pass line of the material to be rolled running in-between and that the disk rolls 3 are opposingly arranged in a manner perpendicularly intersecting with the piercing rolls, the disk roll exchanging apparatus comprising a pair of disk frames 6 each of which supports one of the disk rolls 3 and is located at the side of the mill housing and supported by a rotary shaft so that it can swing open away from the mill housing, a disk roll lifting device 12 for mounting the disk roll 3 to and demounting it from the opened disk frame 6, and a horizontally moving device 18 for carrying and horizontally moving the disk roll lifting device 12.

The disk roll 3 is integrally formed with a shaft 4, and the shaft 4 is supported at both ends via chocks 10 and 11. The disk roll lifting device 12 preferably has a structure capable of positioning the chocks 10 and 11 provided at both shaft ends and the disk roll 3 when the disk roll lifting device 12 supports the disk roll 3. Also, the open position of the disk frame is preferably fixed to a constant position by open positioning means.

(2) A disk roll exchanging method for use in a vertical piercing mill containing a pair of piercing rolls and a pair of disk rolls 3 in a mill housing such that the piercing rolls are opposingly arranged in a vertical direction with a pass line of the material to be rolled running in-between and that the disk rolls 3 are opposingly arranged in a manner perpendicularly intersecting with the piercing rolls, comprising the steps of swinging open a pair of disk frames 6 each of which supports one of the disk rolls 3, fixing each of the opened disk frames 6, moving a disk roll lifting device 12 carried on a horizontally moving device 18 to a disk roll exchange position, lowering the disk roll 3, releasing the disk roll 3 from the disk frame 6, fixedly supporting the disk roll 3 by the disk roll lifting device 12, and moving the disk roll lifting device 12 away from the disk roll exchange position.

The disk roll 3 is integrally formed with a shaft 4, and the shaft 4 is supported at both ends via chocks 10 and 11. When the disk roll 3 is exchanged, the chocks 10 and 11 and the disk roll 3 are preferably supported by the disk roll lifting device 12. The disk frame exchange position is preferably fixed at a specific position.

The disk roll exchanging apparatus and the disk roll exchanging method of the present invention described above are applicable to the exchange of a disk roll supported either in a cantilever manner or at both ends of its shaft. Particularly when a disk roll is supported at both ends of its shaft, the present invention enables automatic exchange of disk rolls by the compact, simple structure of apparatus, to thereby efficiently reduce time for exchange of the disk rollers.

BEST MODE FOR CARRYING OUT THE INVENTION

Figure 1:
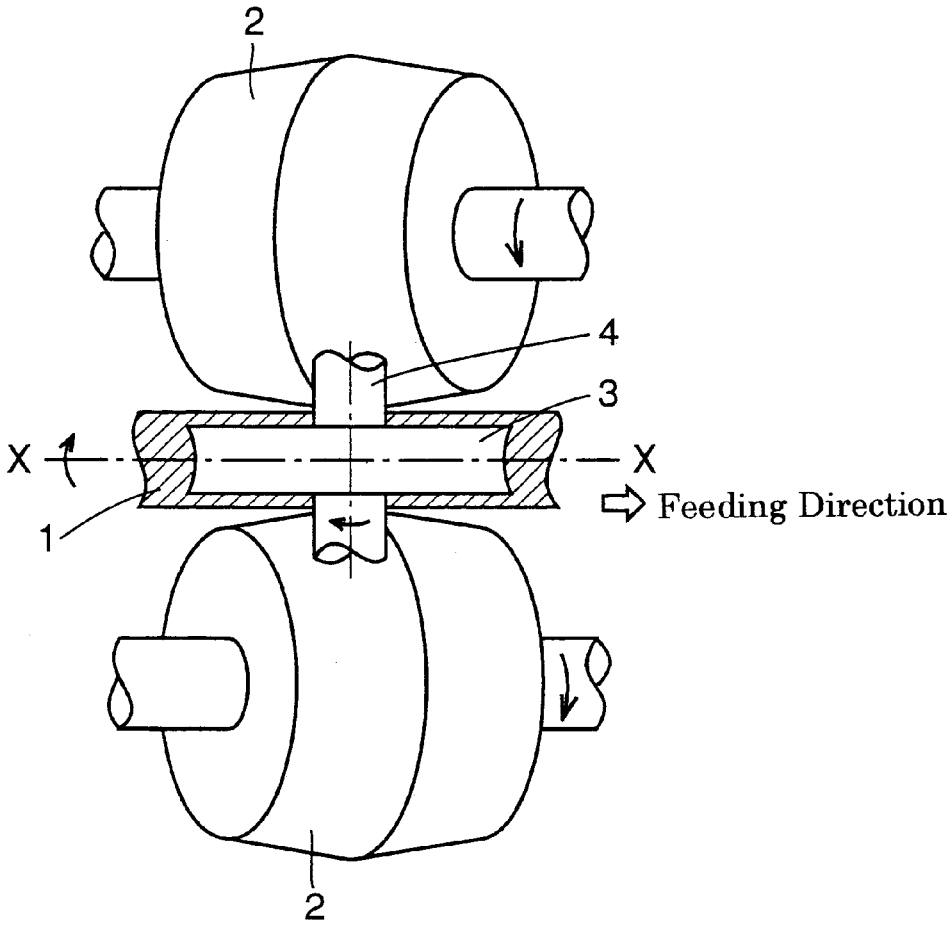
FIG. 1 is a view showing a material being pierced and an arrangement of piercing rolls and disk rolls in a piercing mill.

A disk roll exchanging apparatus of the present invention comprises a pair of disk frames each of which supports a disk roll and is located at the side of the mill housing and supported by a rotary shaft so that it can swing open away from the pass line, a disk roll lifting device for mounting the disk roll 3 to and demounting it from the opened disk frame 6, and a horizontally moving device for carrying and horizontally moving the disk roll lifting device, thereby allowing the disk roll to be mounted to and demounted from the opened disk frame.

A disk roll exchanging method of the present invention is applicable to the above-described disk roll exchanging apparatus for use in a vertical piercing mill and comprises the steps of swinging open a pair of the disk frames each of which supports a disk roll, fixing each of the opened disk frames, moving a disk roll lifting device carried on a horizontally moving device to a disk roll exchange position, lowering the disk roll, releasing the disk roll from the disk frame, fixedly supporting the disk roll by the disk roll lifting device, and moving the disk roll lifting device away from the disk roll exchange position, thereby achieving automatic exchange of disk rolls. When the disk roll is exchanged, the disk frame is preferably fixed to a disk roll exchange position.

According to the disk roll exchanging apparatus and method of the present invention, a disk frame which supports a disk roll is swung open, so that the disk roll integrated with its shaft can be exposed to the exterior of the mill housing. Thus, the workability of disk roll exchange can be improved.

Further, a disk frame is structured such that it is opened when a disk roll is to be replaced, and a fully opened position is used as the disk roll exchange position. Therefore, a disk roll transport device such as a disk roll lifting device can be easily combined with the opened disk frame for disk roll exchange, thereby easily achieving automatic exchange of disk rolls. Thus, a disk roll can be mounted to and demounted from the opened disk frame without using an overhead crane, thereby significantly reducing the working time of disk roll exchange. However, in this case, the opened disk frame must be accurately positioned at the disk roll exchange position. As will be described later, the present invention preferably includes means for positioning the opened disk frame by a simple operation, and secures rigidity required to exchange a disk roll.

The present invention is applicable to the exchange of a disk roll supported either in a cantilever manner or at both ends of its shaft. Accordingly, the present invention is characterized in that even when a disk roll is supported at both ends of its shaft, exchanging disk rolls can be automatically achieved. In this case, the disk roll lifting device is preferably structured such that chocks provided at both shaft ends and the disk roll are properly positioned.

The effects of the present invention will next be described in detail with reference to FIGS. 2 to 7 which specifically show an exemplary structure of the present invention. In FIGS. 2 to 7, the same members are denoted by common reference numerals.

Figure 2:
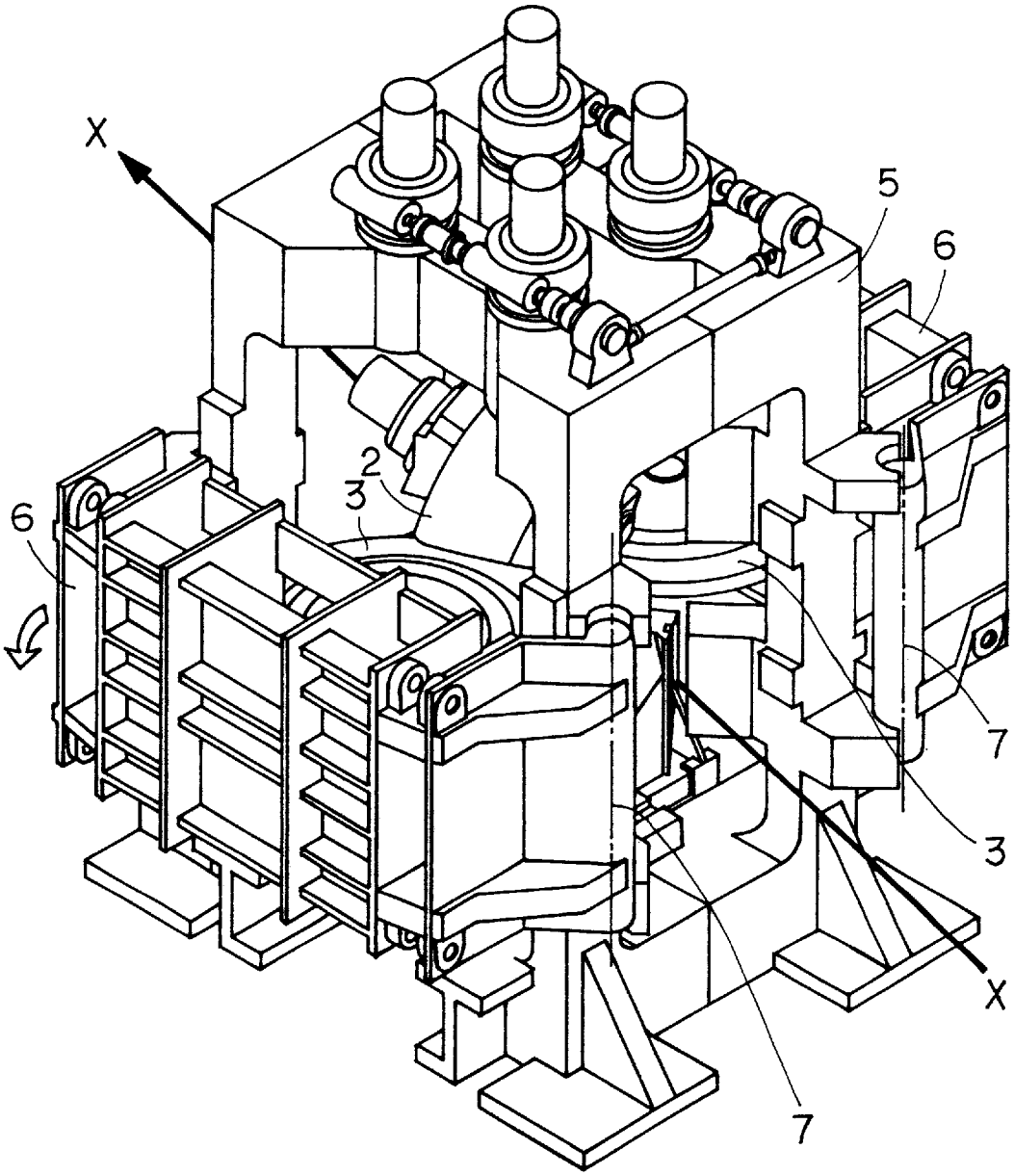
FIG. 2 is a view showing the structure of a mill housing of a vertical piercing mill according to the present invention.

FIG. 2 shows the structure of a mill housing of a vertical piercing mill according to the present invention. A mill housing 5 serving as the main body of a piercing mill is open at its sides oriented perpendicularly to a pass line X—X of a material to be rolled and houses a pair of piercing rolls 2 and a pair of disk rolls 3 such that the piercing rolls are opposingly arranged above and below the pass line X—X and that the disk rolls 3 are opposingly arranged in a manner perpendicularly intersecting with the piercing rolls 2. A pair of disk frames 6 are provided at the sides of the mill housing 5 and supported by rotary shafts 7 so that they can swing open away from the pass line X—X. The disk roll 3 integrated with its shaft is supported within each of the disk frames 6.

Figure 3:
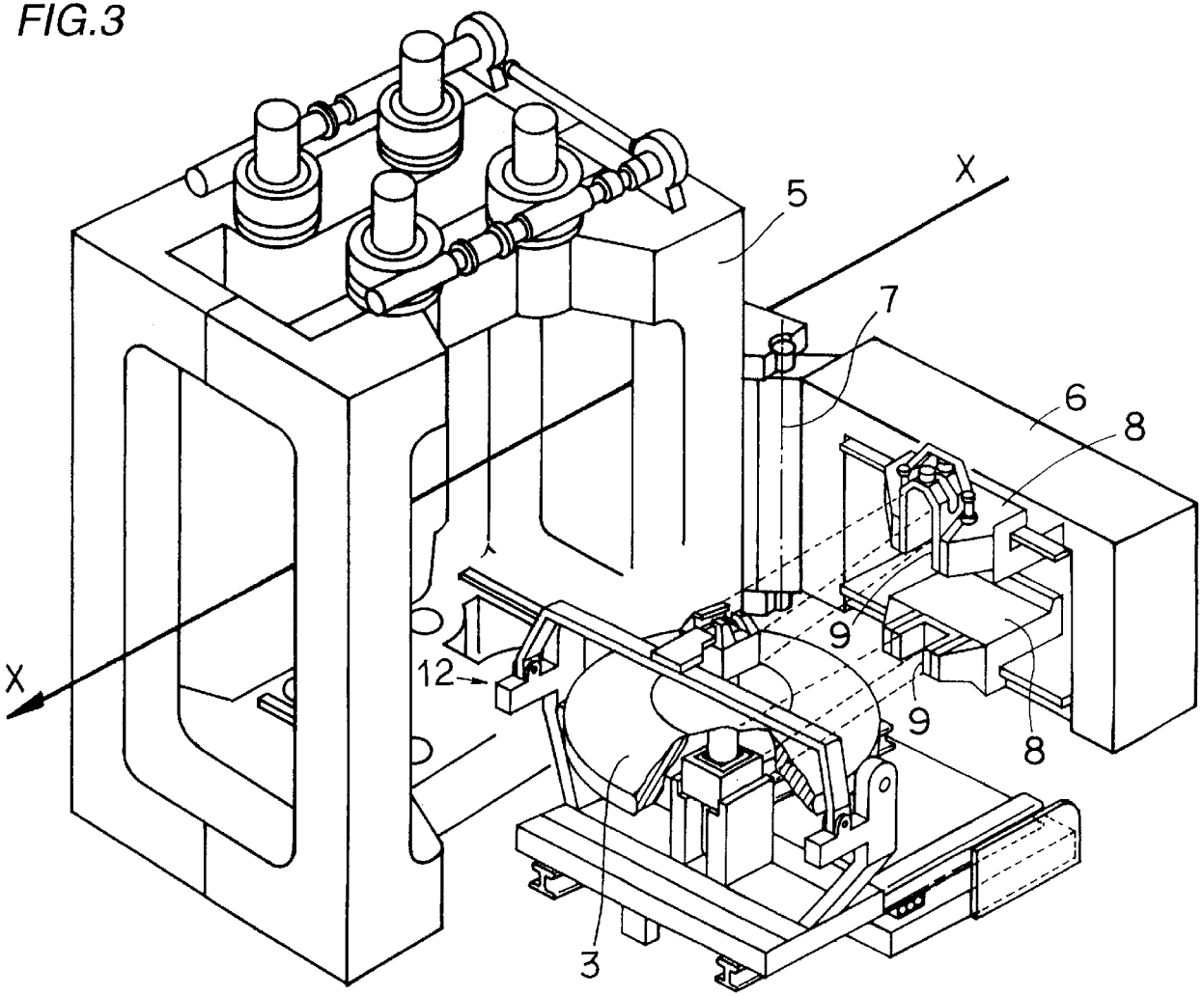
FIG. 3 is a perspective view showing the overall structure of the mill housing when a disk frame is swung open to a position for exchanging the disk roll.

FIG. 3 is a perspective view showing the overall structure of the mill housing when the disk frame is swung open to a disk roll exchange position. The disk frame 6 is designed to be supported by the rotary shaft 7, and swung by the action of an unillustrated cylinder for swinging the disk frame 6. When the disk roll is exchanged, the disk frame is fully swung open to the disk roll exchange position, and the disk roll is demounted from and mounted to the disk frame 6 by use of the disk roll lifting device 12.

Figure 4:
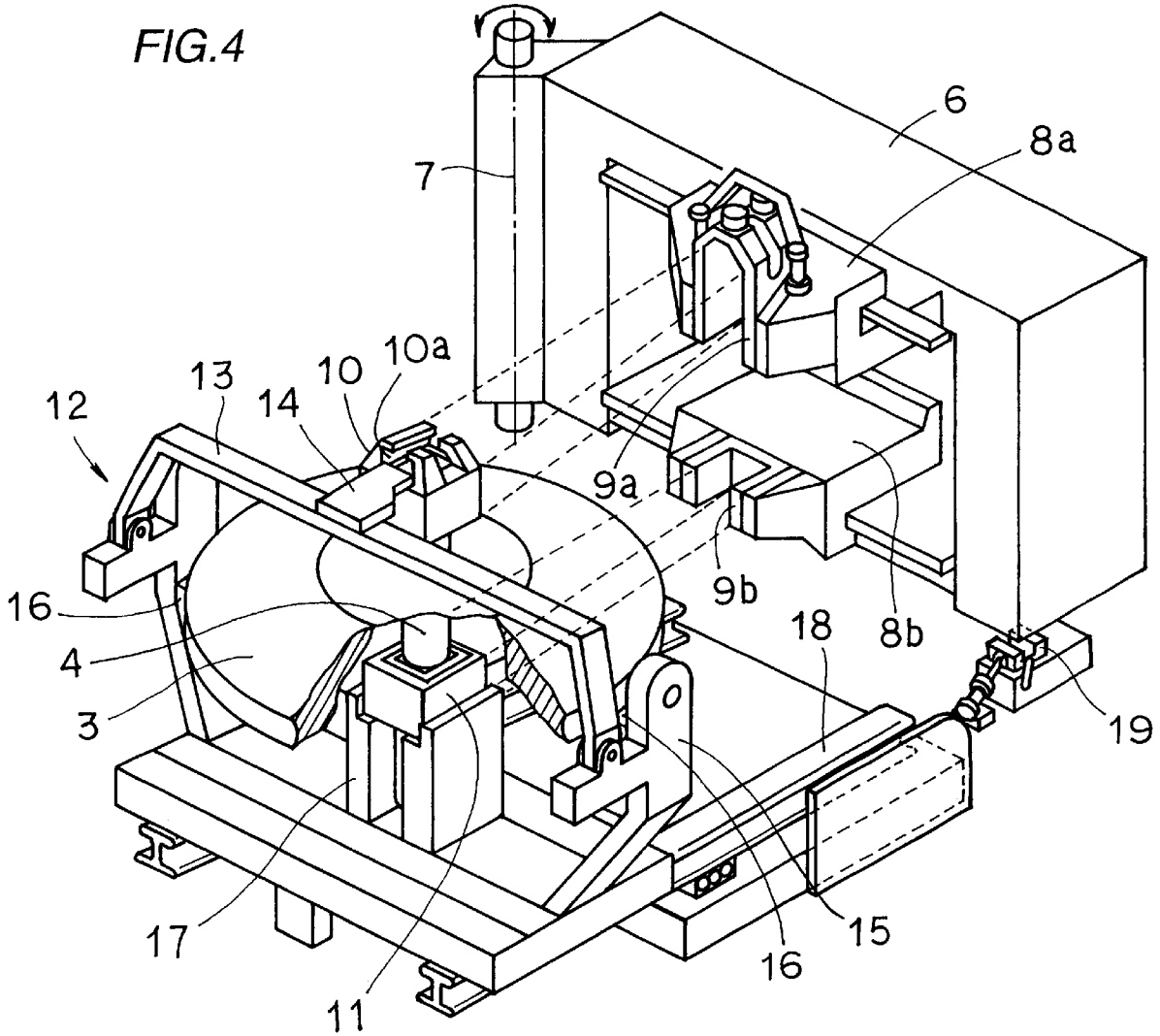
FIG. 4 is a perspective view showing the structure of a main portion when a disk roll integrated with its shaft is transferred from the disk frame to the disk roll lifting device for disk roll exchange.

FIG. 4 is a perspective view showing the structure of a main portion when a disk roll integrated with its shaft is transferred from the disk frame to the disk roll lifting device for disk roll exchange. FIG. 4 shows the case where the disk roll 3 is supported at both ends of its shaft. In order to support the disk roll 3 at both ends of its shaft, the disk frame 6 is internally provided with a pair of sliding frames 8 comprising an upper sliding frame 8*a* and a lower sliding frame 8*b*. An upper adjustment frame 9*a* is provided at the central tip portion of the upper sliding frame 8*a*, and a lower adjustment frame 9*b* is provided at the central tip portion of the lower sliding frame 8*b*.

The disk roll 3 and a shaft 4 are integrated into a single unit. An upper chock frame 10 having a built-in chock is attached to the upper portion of the shaft 4, and a lower chock frame 11 having a built-in chock is attached to the lower portion of the shaft 4.

The upper chock frame 10 has a support groove 10*a* for receiving a holder 14, which will be described later, and is fitted into the upper adjustment frame 9*a* of the upper sliding frame 8*a*. The lower chock frame 11 is fitted into the lower adjustment frame 9*b* of the lower sliding frame 8*b*. By fitting the chock frames 10 and 11 into the upper and lower adjustment frames 9*a* and 9*b*, respectively, as described above, the disk roll 3 is supported at both ends of its shaft 4.

The disk roll lifting device 12 used for exchanging the disk roll 3 comprises a lifting lever 13, a holder 14 for holding the upper chock 10, lifting supports 15, roll rests 16, and a lower chock rest 17. A horizontally moving apparatus 18 is used to carry and move the disk roll lifting device 12 when the disk roll 3 is to be replaced. That is, the disk roll lifting device 12 carried on the horizontally moving device 18 is moved horizontally to a disk roll exchange position. After the disk roll 3 is transferred onto the disk roll lifting device 12, the disk roll lifting device 12 is moved horizontally away from the disk roll exchange position.

When the disk roll 3 is released from the disk frame 6 and is then supported by the disk roll lifting device 12, the chock frames 10 and 11 located at both ends of the shaft 4 become free to rotate. In order to restrain the upper chock frame 10 from rotating, the lifting lever 13 is swung up so as to insert the holder 14 into the support groove 10*a*. The lower chock frame 11 is supported from below by the lower chock rest 17 to thereby be restrained from rotating. Further, the disk roll 3 is fixedly positioned by resting it on the roll rests 16 of the lifting supports 15.

The procedure for demounting a disk roll from a disk frame will next be described in detail through steps (a) to (c). To mount a disk roll onto a disk frame, the steps (a) to (c) may be followed in reverse.

(a) Swinging a Disk Frame Open and Positioning it at an Exchange Position

When the disk roll is removed, the pair of disk frames supporting the disk roll is swung open to a predetermined swing end position so as to expose the disk roll. Then, the opened disk frame is preferably positioned such that it is fixed at the exchange position.

Figure 5:
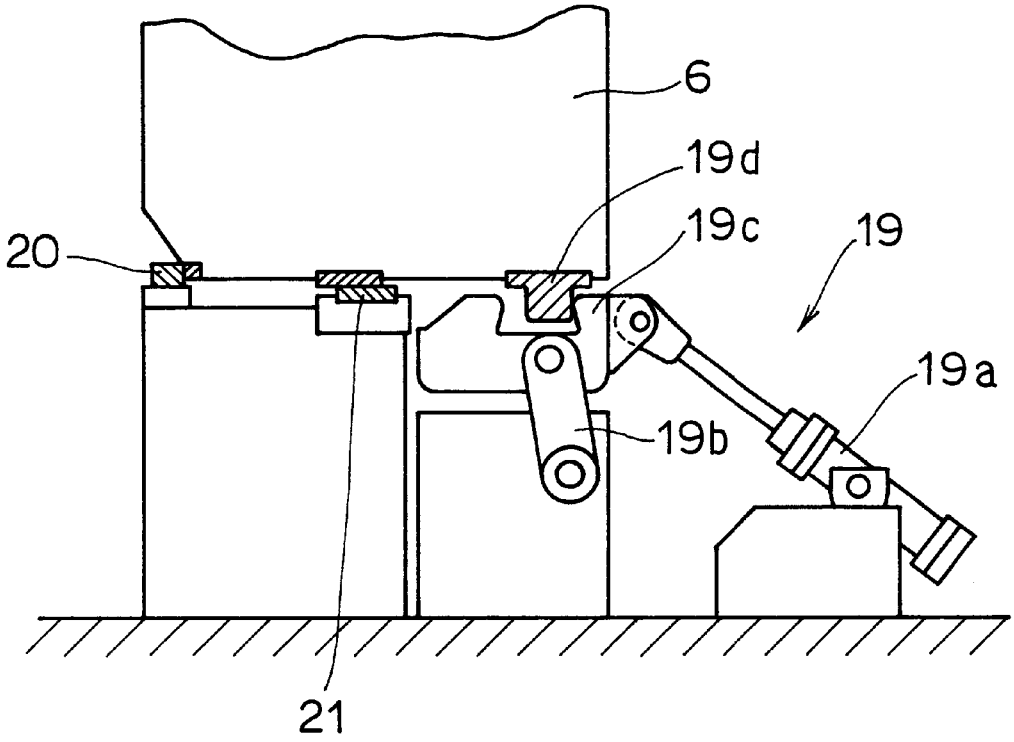
FIG. 5 is a view showing an example of the structure of means for fixedly positioning an opened disk frame at the position for exchanging the disk roll.

FIG. 5 shows positioning means 19 for fixing the opened disk frame 6 at the exchange position. As shown in FIG. 5, the positioning means 19 comprises a hydraulic cylinder 19*a*, a clamp lever 19*b*, a clamp 19*c*, and a clamp block 19*d*. The hydraulic cylinder 19*a* operates so as to fix the opened disk frame 6 at the exchange position via the clamp block 19*d* attached to the disk frame 6. In this case, a vertical liner 20 and a horizontal liner 21 are preferably used to position and support the disk frame 6. The disk frame 6 is swung open until it abuts the vertical liner 20, thereby being positioned. Further, the disk frame 6 is supported via the horizontal liner 21 in order to prevent it from deflecting due to its own weight.

(b) Horizontally Moving a Disk Roll Lifting Device and Demounting a Disk Roll

An empty disk roll lifting device is carried and placed on a horizontally moving device by an overhead crane at a lift-up-and-down position. Then, the disk roll lifting device is horizontally moved to a disk roll exchange position.

Figure 6:
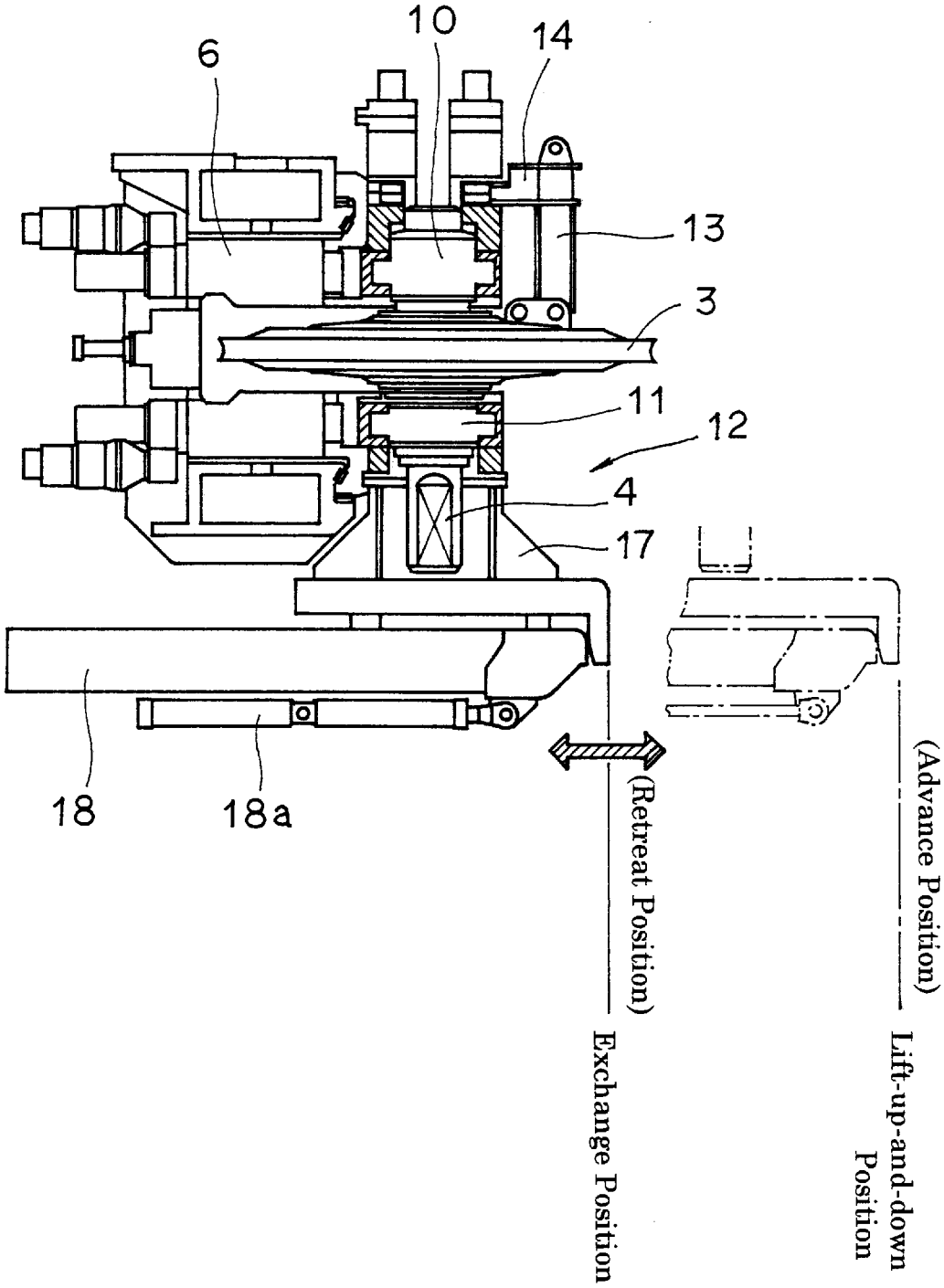
FIG. 6 is a vertical sectional view showing a disk roll lifting device after it is horizontally moved to a disk roll exchange position.

FIG. 6 shows the disk roll lifting device 12 after it is horizontally moved to the disk roll exchange position. The disk roll lifting device 12 is carried by an overhead crane and placed on the horizontally moving device 18 at its advance position, i.e., lift-up-and-down position represented by a dot-and-dash line in FIG. 6. Thereafter, by operating of a hydraulic cylinder 18*a*, the disk roll lifting device 12 is moved horizontally to exchange position which is its retreat position.

Before the disk roll lifting device 12 is moved toward the disk frame 6, the disk roll 3 is held at its upper limit position through height and front/back position adjustment of the disk frame 6, while the disk roll 3 is supported by the disk frame 6. Accordingly, when the disk roll lifting device 12 is horizontally moved to the disk roll exchange position, there exists a sufficient clearance between the disk roll 3 and the disk roll lifting device 12. Subsequently, the disk roll 3 is lowered toward the disk roll lifting device 12 to thereby shift the support of the disk roll 3 to the disk roll lifting device 12. In this state, the disk frame 6 releases the disk roll 3, for example, by uncoupling the upper and lower chock frames 10 and 11. Thus, the disk roll 3 is demounted from the disk frame 6.

Figure 7:
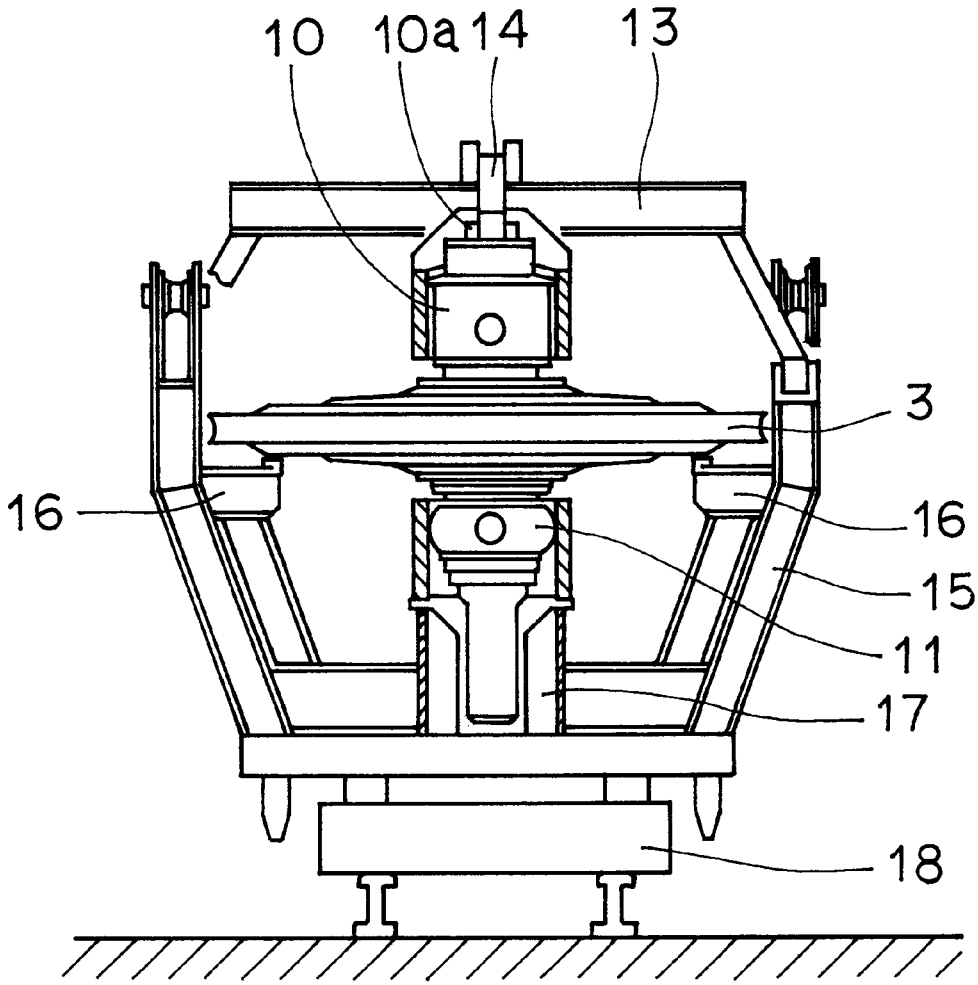
FIG. 7 is a side sectional view showing the disk roll lifting device which fixedly supports a disk roll.

FIG. 7 is a side cross-sectional view showing the disk roll lifting device which fixedly supports the disk roll. The holder 14 is inserted into the support groove 10*a* of the upper chock frame 10 so that the disk roll 3 is fixedly held by the disk roll lifting device 12. The lower chock frame 11 is supported from below by the lower chock rest 17 to thereby be restrained. Further, the disk roll 3 is fixedly positioned by resting it on the pair of roll rests 16. Thus, through the operation described with reference to FIGS. 6 and 7, the procedure for demounting the disk roll 3 from the disk frame 6 has been completed.

(c) Carrying Out the Disk Roll Lifting Device

After the disk roll 3 is fixedly positioned and the upper and lower chock frames 10 and 11 are fixedly held as described above and shown in FIG. 7, the disk roll lifting device 12 is again horizontally moved by the horizontally moving device 18 to the advance position, i.e., lift-up-and-down position shown in FIG. 6. Subsequently, the disk roll lifting device 12 is carried out by an overhead crane while it is fixedly supporting the disk roll 3.

A new disk roll can be mounted onto the disk frame by following the above-described step (a) to (c) in reverse. As described above, except for transport of the disk roll lifting device by an overhead crane, the procedure for exchanging disk rolls can be carried out automatically, thereby significantly reducing working time and improving work efficiency.

INDUSTRIAL APPLICABILITY

As described above, according to the disk roll exchanging apparatus and the disk roll exchanging method of the present invention, through employment of a simple structure, automatic exchange of disk rolls can be achieved so that time for exchange can be reduced, and the workability of disk roll exchange can be improved even when a disk roll is supported at both ends of its shaft. Further, seamless steel tubes having a variety of diameters can be produced at a high efficiency in small lots.

Therefore, the disk roll exchanging apparatus and the disk roll exchanging method according to the present invention can be widely utilized in fields where high-efficiency production of seamless steel tubes is oriented.

What is claimed is:

1. A disk roll exchanging apparatus for use in a vertical piercing mill containing a mill housing having a pair of vertically opposed piercing rolls disposed on opposite sides of a pass line of the material to be rolled, and a pair of opposed disk rolls on opposite sides of said pass line perpendicularly disposed with respect to said piercing rolls, said disk roll exchanging apparatus comprising:

a pair of disk frames each being operative to support each of said disk rolls, each of said disk frames being pivotally supported on said mill housing by a pivot shaft to enable opening of said disk frames away from the pass line, said disk rolls each containing a shaft and chocks supporting said shaft at opposite ends thereof, a disk roll lifting device operative for mounting and demounting said disk rolls with respect to said disk frames, said disk roll lifting device containing a chock rest for supportedly receiving one of said chocks, and an upper chock holder movably disposed on said lifting device and operative to supportedly engage the other of said chocks and to retain said other chock in aligned relation with respect to said rest-supported chock, a moving device carrying said disk roll lifting device, and means for horizontally moving said moving device to permit mounting and demounting of said disk roll with respect to said disk frame.

2. A disk exchanging apparatus according to claim 1 including positioning means operative to fix said disk frame at a constant position during exchange of said disk roll between said frame and said disk roll lifting device.

3. A disk roll exchanging apparatus for use in a vertical piercing mill containing a pair of piercing rolls and a pair of disk rolls in a mill housing such that the piercing rolls are opposingly arranged in a vertical direction with a pass line of the material to be rolled running in-between and that the disk rolls are opposingly arranged in a manner perpendicularly intersecting with the piercing rolls, and are integrally formed with a shaft, supporting the shaft at both ends via chocks, the disk roll exchanging apparatus comprising:

a pair of disk frames each of which supports one of the disk rolls and is located at the side of the mill housing and supported by a pivot shaft so that it can swing open away from the pass line;

a disk roll lifting device for mounting the disk roll to and demounting it from an opened disk frame; and a horizontally moving device for carrying and horizontally moving the disk roll lifting device, thereby allowing the disk roll to be mounted to and demounted from the opened disk frame, wherein the disk roll lifting device has a structure such that the chocks provided at both shaft ends and the disk roll are properly positioned when the disk roll lifting device supports the disk roll.

4. A disk roll exchanging apparatus according to claim 3, wherein, when the disk roll supported on the disk frame is exchanged, the disk frame is fixed at a constant position by positioning means.

5. A disk roll exchanging method for use in a vertical piercing mill containing a pair of piercing rolls and a pair of disk rolls in a mill housing such that the piercing rolls are opposingly arranged in a vertical direction with a pass line of the material to be rolled running in-between and that the disk rolls are opposingly arranged, each in a disk frame pivotally attached to said mill housing, in a manner perpendicularly intersecting with the piercing rolls, the disk roll exchanging method comprising the steps of:

swinging open a disk frame;

moving a disk roll lifting device with respect to said opened disk frame to a disk roll exchange position;

releasing the disk roll from the disk frame;

lowering the disk roll to support a lower end thereof in said lifting device;

fixedly supporting an upper end of said disk roll by the disk roll lifting device; and moving the disk roll lifting device away from the disk roll exchange position.

6. The disk roll exchanging method according to claim 5, including the steps of:

integrally forming said disk roll with a shaft, supporting the shaft at both ends via chocks, and fixedly supporting the chocks and the disk roll by the disk roll lifting device when the disk roll is transferred onto the disk roll lifting device.

7. The disk roll exchanging method according to claim 6, including the step of fixing to a constant position the disk frame exchange position of the disk frame to which the disk frame is swung to be opened.

8. The disk roll exchanging method according to claim 5, including the step of fixing to a constant position the disk frame exchange position of the disk frame to which the disk frame is swung to be opened.

* * * * *